US006467408B1

(12) United States Patent
Hillebrand

(10) Patent No.: US 6,467,408 B1
(45) Date of Patent: Oct. 22, 2002

(54) ROTARY PRESS WITH A FIVE-CYLINDER PRINTING UNIT

(75) Inventor: Bernd Anton Hillebrand, Bergrheinfeld (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/857,202

(22) Filed: Jun. 22, 2001

(30) Foreign Application Priority Data

Dec. 30, 1998 (DE) ..... 198 60 538
Apr. 30, 1999 (DE) ..... 199 19 864

(51) Int. Cl.[7] ..... B41F 7/02
(52) U.S. Cl. ..... 101/217; 101/177; 101/180
(58) Field of Search ..... 101/216, 217, 101/218, 219, 220, 177, 178, 179, 180, 181, 182, 183, 184, 185, 247

(56) References Cited

U.S. PATENT DOCUMENTS 6,363,848 B1 * 4/2002 Weschenfelder ..... 101/138

FOREIGN PATENT DOCUMENTS

| | | |
|---|---|---|
| CH | 459 266 | 9/1968 |
| DE | 1 827 845 | 3/1961 |
| DE | 03-189153 A | 8/1991 |
| DE | 43 03 904 A1 | 8/1994 |
| GB | 1 348 021 | 3/1974 |

* cited by examiner

*Primary Examiner*—Ren Yan
(74) *Attorney, Agent, or Firm*—Jones, Tullar & Cooper, PC

(57) ABSTRACT

A rotary printing unit consists of a pair of modules, each of which has two pairs of cooperating formed and transfer cylinders and a counter-pressure cylinder. A multi-variable cylinder arrangement is utilized. The counter-pressure cylinder in each of the five-cylinder modules can be placed on either side of a line extending between the axes of rotation of the transfer cylinders in the two pairs of cooperating formed cylinders and transfer cylinders in each module.

7 Claims, 5 Drawing Sheets

ROTARY PRESS WITH A FIVE-CYLINDER PRINTING UNIT

FILED OF THE INVENTION

The present invention relates to a rotary printing press with a five-cylinder printing unit. Two formed cylinders, two transfer cylinders and one counter-pressure cylinder, whose position can be changed, constitute the printing unit.

DESCRIPTION OF THE PRIOR ART

A five-cylinder print unit has become known from CH-SP 459 266. It has two pairs of formed cylinders and two pairs of rubber blanket cylinders. The rubber blanket cylinders can be selectively placed against a counter-pressure cylinder. A "V"-shaped, or approximately "V"-shaped arrangement of the cylinder pairs and the counter-pressure cylinder is achieved by this prior art device.

It is furthermore known, from DE-GM 18 27 845, to arrange a counter pressure cylinder displaceable or pivotally in a five-cylinder print unit in order to bring the counter-pressure cylinder selectively into contact with one or with several rubber blanket cylinders.

DE 43 03 904 A1 describes printing units in a tower construction. Five-cylinder printing units are provided in a "V"-shaped or "W"-shaped arrangement.

SUMMARY OF THE INVENTION

The object of the present invention is based on providing a rotary printing press with a five-cylinder printing unit.

In accordance with the present invention, this object is attained by providing a five-cylinder printing unit with two formed cylinders, two transfer cylinders and a counter-pressure cylinder whose position can be changed. The counter-pressure cylinder can be shifted between several positions with respect to the axes of rotation of the transfer cylinders.

The advantages which can be achieved by the present invention reside, in particular, in that a plurality of different cylinder arrangements can be created from a standard print unit module, for example a five-cylinder printing unit. A plurality of print unit configurations and paper web guides are possible. To this end, the position of the counter-pressure cylinder can be changed. It is possible, in the process, to rearrange the rubber blanket cylinders at any time, and to combine them, as desired, with adjoining rubber blanket cylinders, or with counter-pressure cylinders. Such a rearrangement can be performed by the manufacturer, as well as by the customer as often as desired.

The following print unit configurations can be achieved by means of two standard print unit modules:

10-satellite printing unit in an upright or reclining form, 9-satellite printing unit, H printing unit, for example for a so-called eight-tower, formed by several H printing units on top of each other , two I printing units.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENTS

Figure 1:
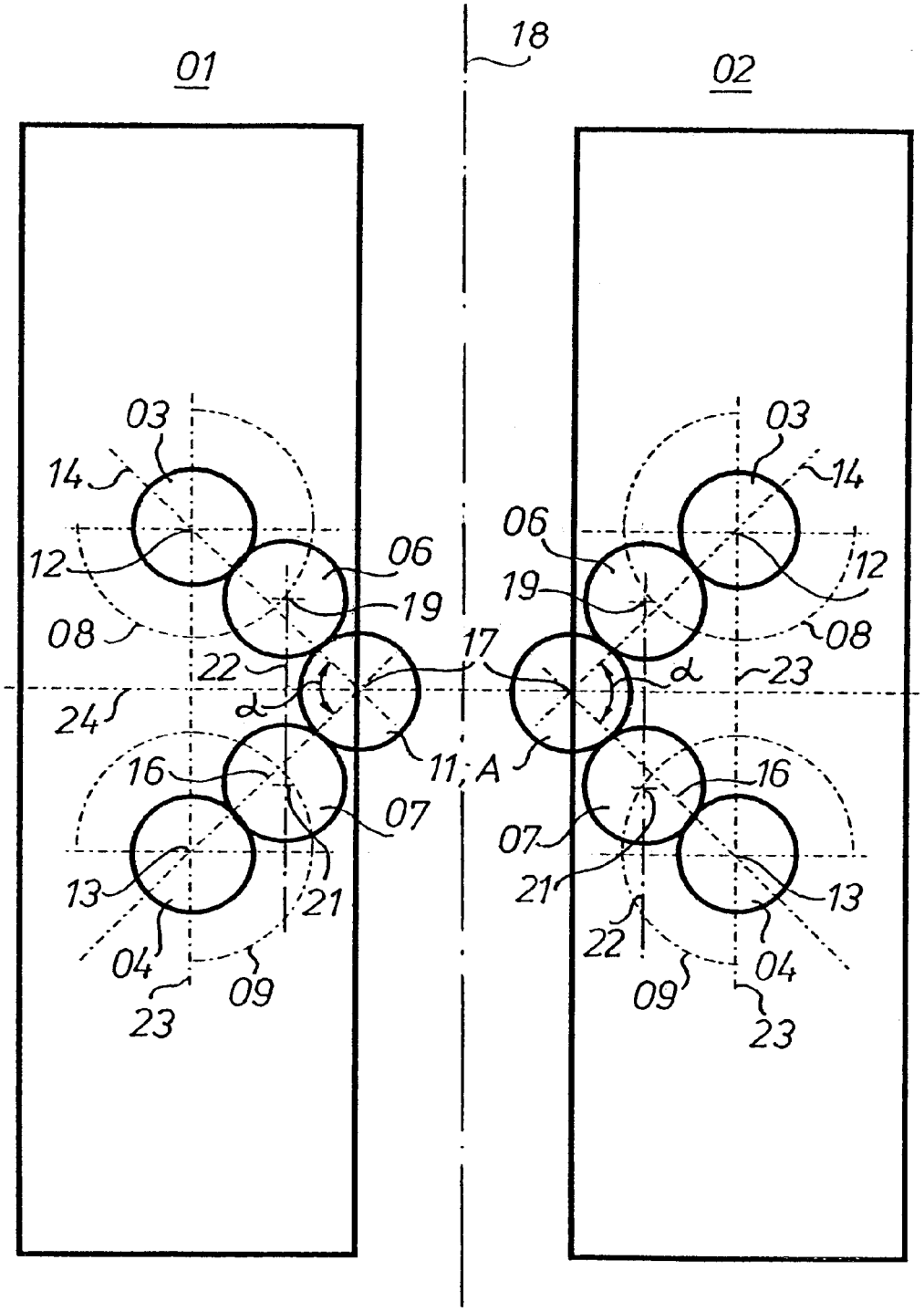
FIG. 1, two 5-cylinder standard print units in a configuration as a 10 satellite printing unit in a "reclining" construction, FIG. 2, the print units represented in FIG. 1 in the form of a 10 satellite printing unit in an "upright" construction, FIG. 3, the print units represented in FIG. 1 in the form of a 9 satellite printing unit, FIG. 4, the print units represented in FIG. 1 in the form of an H printing unit and in, FIG. 5, the print units represented in FIG. 1 in the form of two I printing units.
Figure 3:
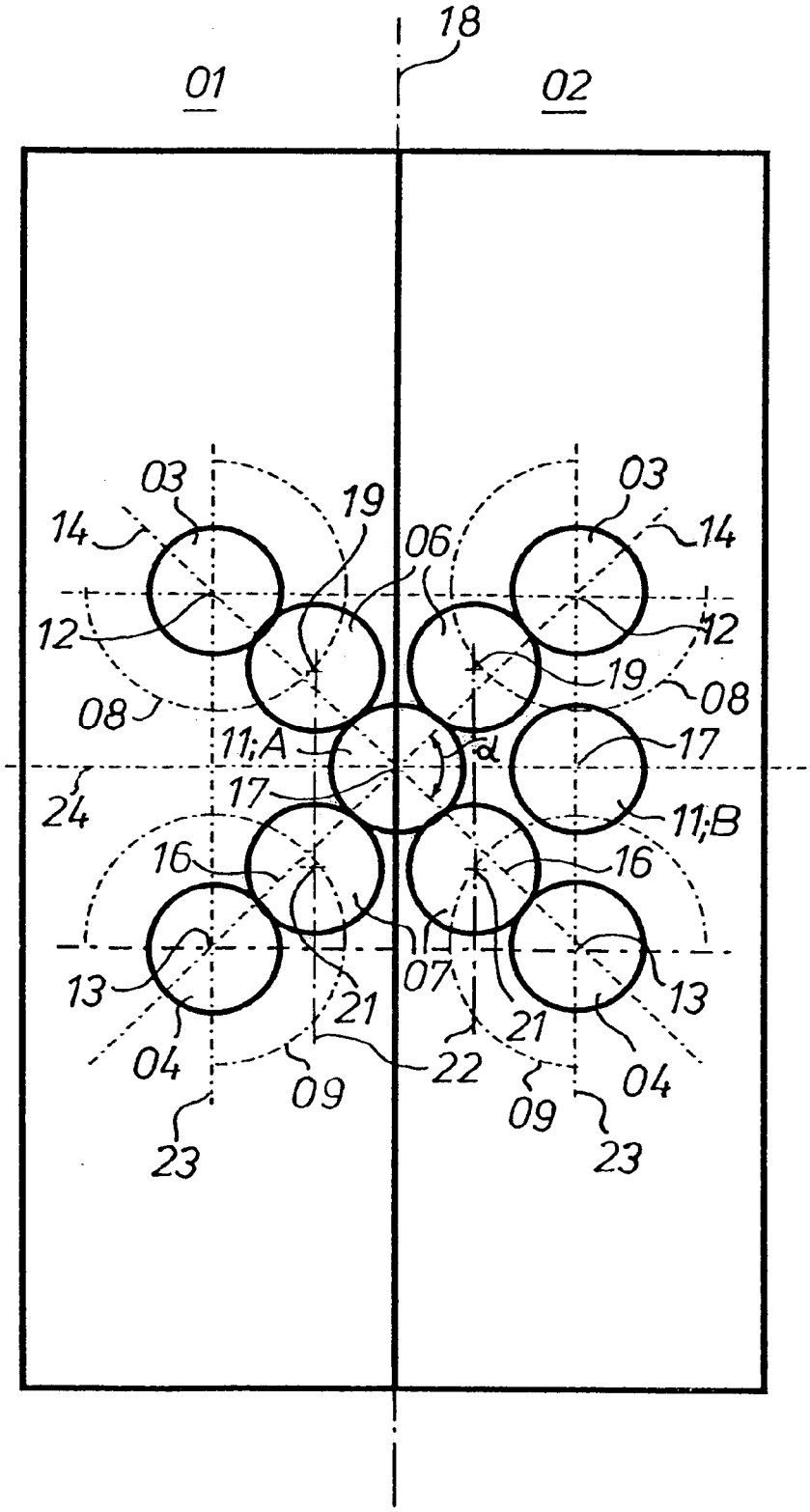
Figure 4:
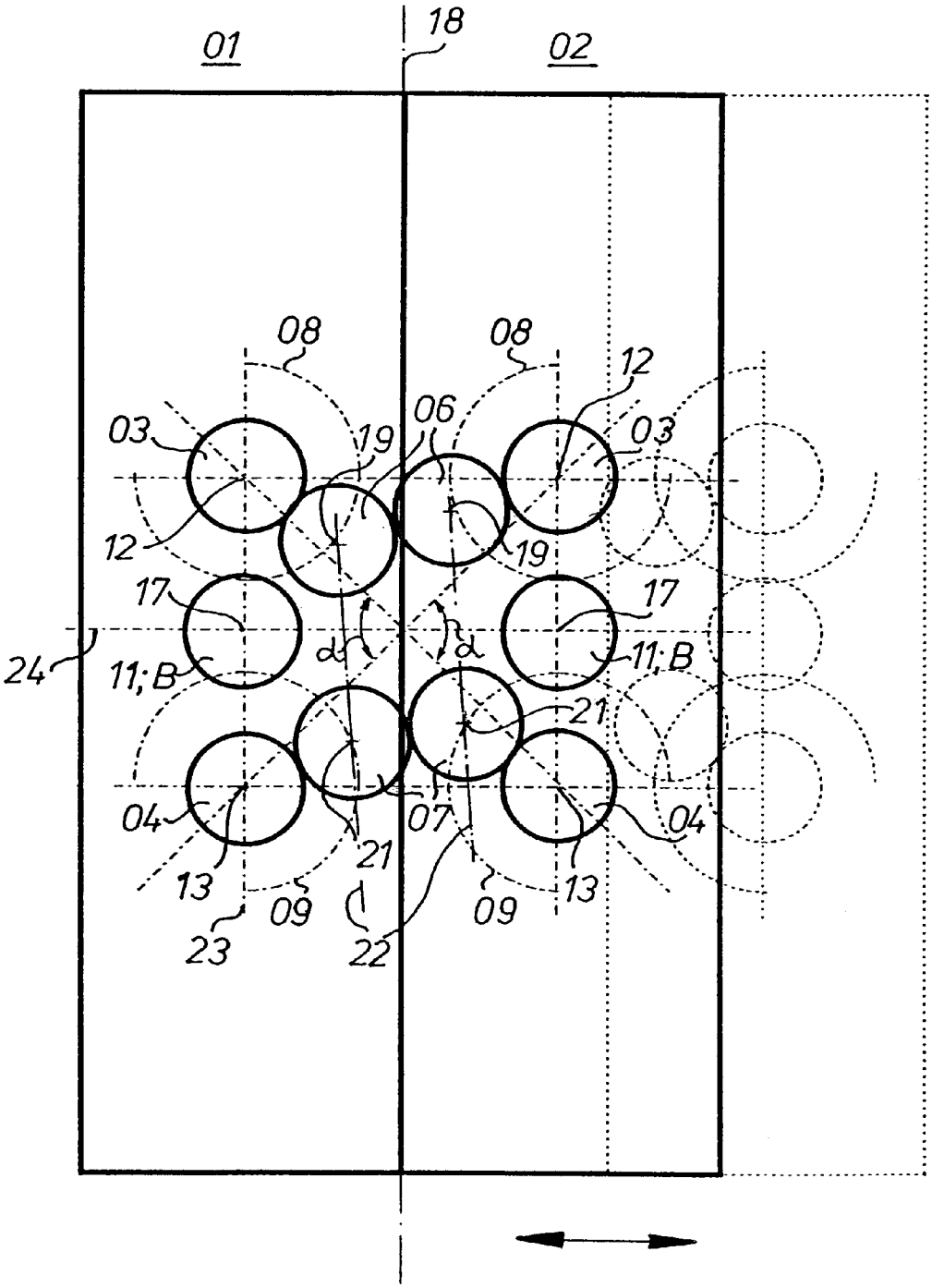
Figure 5:
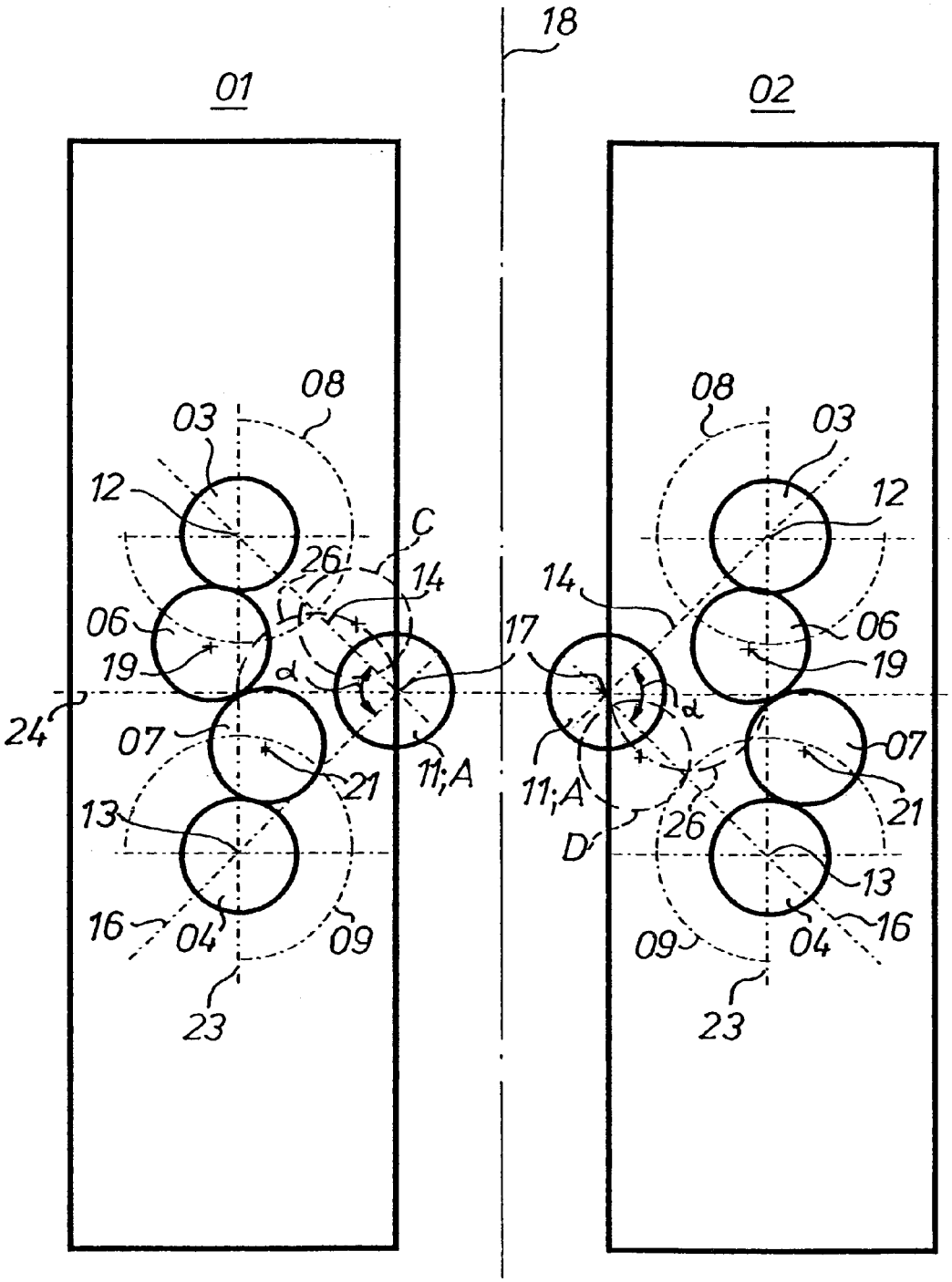

Two rotatable formed or plate cylinders 03, 04 which, for example, can be driven by individual drive mechanisms, which are not specifically represented, are each seated or supported in a frame or module 01, 02, as seen in each one of FIGS. 1–5. A transfer cylinder, in the configuration of, for example a rubber blanket cylinder 06, 07, which is driven by the formed cylinder 03, 04 and which can be moved, or pivoted, around its associated formed cylinder 03, 04, is assigned to each formed cylinder 03, 04. For example, this movement of rubber blanket cylinder 06, 07 can take place along a circular path 08, 09. In the course of the movement of the rubber blanket cylinders 06, 07 on the circular path 08, 09, it is possible to bring both rubber blanket cylinders 06, 07 into contact with each other, thereby forming I printing units, as seen in FIG. 5 , or they can each be placed against a counter-pressure cylinder 11 which is arranged between the pairs of cylinders 03, 06 and 04, 07, as seen in FIG. 1. The formed cylinders 03, 04, for example, are suitably eccentrically seated, and the rubber blanket cylinders 06, 07 are seated in double eccentric devices.

In the configuration depicted in FIG. 1, the counter-pressure cylinder 11 in the first module 01 can be in a first position A facing the second module 02 . In this position A, lines 14, 16 extending through the centers of rotation 12, 13 of the formed cylinders 03, 04 and intersecting in the center of rotation 17 of the counter-pressure cylinder 11 define an angle $\alpha$, for example 90°. The cylinders 03, 06, 11, 07, 04 are arranged in the shape of a "V".

Figure 2:
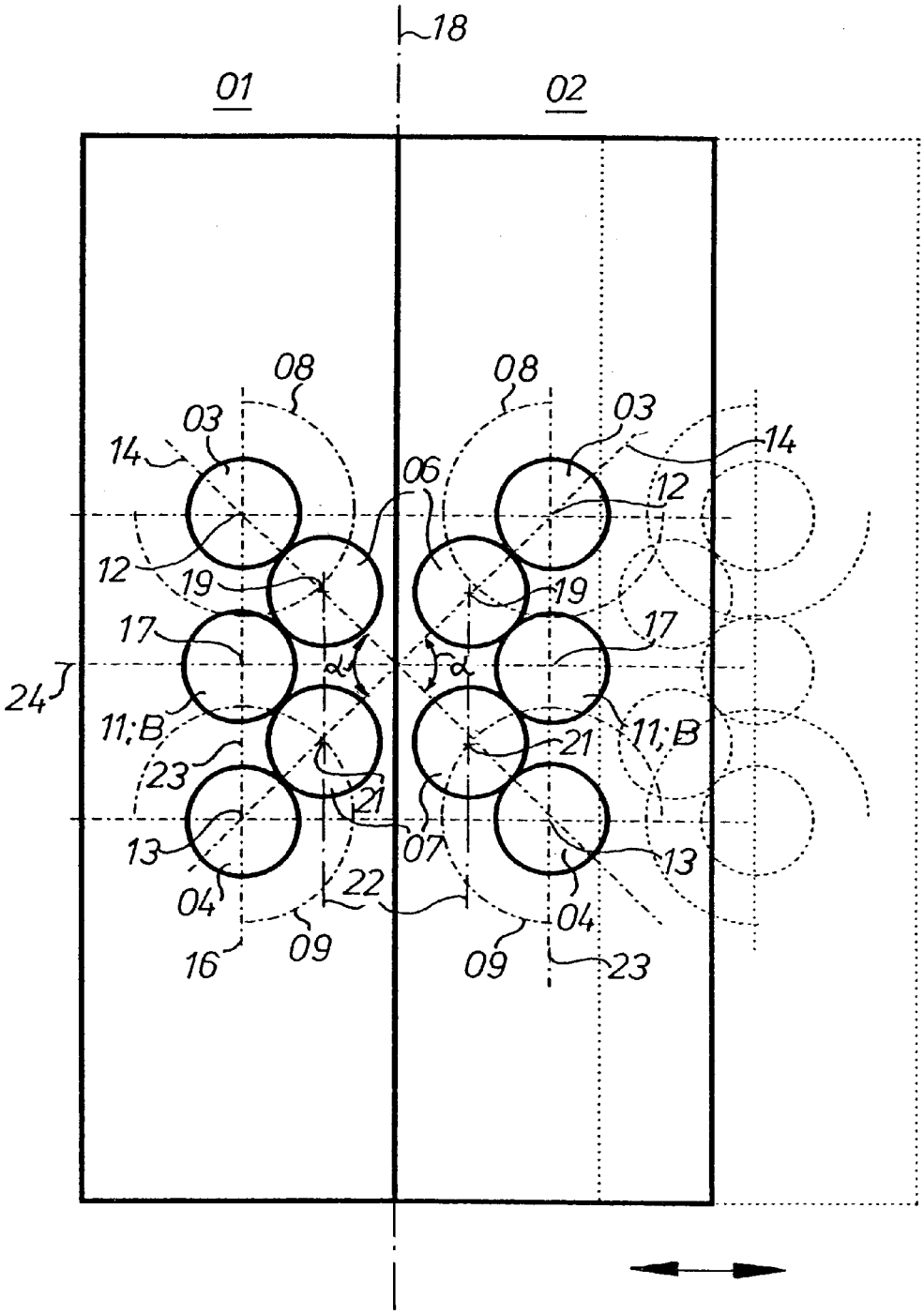

It is possible to bring the counter-pressure cylinder 11 of each module 01, 02 into a second position B, for example by supporting it on a linear guide, which is not specifically represented, extending in the horizontal direction 24. This position B is located behind an imaginary, for example vertical, connecting line 22, as seen in FIGS. 2, 4, which connecting line 22 connects the centers of rotation 19, 21 of the rubber blanket cylinders 06, 07. The cylinders 03, 06, 11, 07, 04 now are arranged in the shape of a "W". This "W" shape is seen most clearly in FIGS. 2 and 4.

Prior to moving the counter-pressure cylinder 11 from the first position A into the second position B, or vice versa, the rubber blanket cylinders 06, 07 are pivoted on their respective circular paths 08, 09 into a position which makes possible the linear displacement or pivoting of the counter-pressure cylinder 11. In this pivoted position of the blanket cylinders, a spacing distance between the two surfaces of the rubber blanket cylinders 06, 07 is greater than the diameter of the counter-pressure cylinder 11.

The counter-pressure cylinder 11 can be guided on a curved path having the shape of a circle, or being approximately U-shaped. A circular-shaped curved path of travel for counter-pressure cylinder 11 is identified by 26 in FIG. 5.

It is furthermore possible to arrange the rubber blanket cylinder 06, 07 displaceable in the horizontal or vertical directions around the formed cylinder 03, 04.

An arrangement of the cylinders 03, 04, 06, 07, 11 in the first module 1 may correspond to a mirror-inverted arrangement of the corresponding cylinders in the second module 02; i.e. with the cylinders inverted along a vertical line 18 located between the modules 01, 02 as shown in FIGS. 1 and 4. For this reason, the same reference symbols are used for identical components or terms in FIGS. 1 and 4.

At least one module, such as the first module 01, is arranged displaceable with respect to the second module 02, i.e. movable or fixable in place, for example.

The several depicted and described configurations of the cylinders 03, 04, 06, 07, 11 can be achieved by an arrangement of the modules 01, 02 in pairs, spaced apart or adjoining each other:

a) two 5-cylinder standard print units in a configuration as a 10 satellite printing unit in a "reclining" construction, as shown in FIG. 1;

b) the print units described above in a), but in the form of a 10 satellite printing unit in an "upright" construction in accordance with the configuration shown in FIG. 2;

c) the print units described above in a), but in the form of a 9 satellite printing unit in accordance with the configuration of FIG. 3, wherein the right counter-pressure cylinder 11 of the module 02 in the position B is not in operation, d) the print units described above in a), but in the form of an H printing unit in accordance with the configuration of FIG. 4, wherein the left and right counter-pressure cylinders 11, in the positions B, are not in operation; and in e) the print units described above in under a), but in the form of I printing units in accordance with the configuration of FIG. 5, wherein the counter pressure cylinders in the position A are not in operation. In this last-described configuration, it is advantageous if each one of the counter- pressure cylinders 11 is pivot able on the curved path 26. For example, the counter-pressure cylinder 11 of the module 01 can be brought into a position C, and the counter-pressure cylinder 11 of the module 02 into a position D, each shown in dashed lines in FIG. 5. Thus, a paper web can pass, without hindrance, between the rubber blanket cylinders 06, 07 of both I printing units.

The above described pairs of modules 01, 02 can be arranged behind each other, as well as above each other.

Known inking units and, if required, damming units, which are not specifically represented, are assigned to each formed or printing plate cylinder 03, 04.

While preferred embodiments of a rotary press with a five-cylinder printing unit in accordance with the present invention have been set forth fully and completely herein above, it will be apparent to one of skill in the art that a number of changes in for example, the overall sizes of the cylinders, the specific drive arrangements for the cylinders and the like could be made without departing from the true spirit and scope of the present invention which is to be limited only by the following claims.

What is claimed is:

1. A rotary printing press comprising:

at least a first five-cylinder printing unit, said five-cylinder printing unit having first and second pairs of formed cylinders and cooperating transfer cylinders and a counter-pressure cylinder; and a connecting line extending between axes of rotation of said transfer cylinders in said first and second pairs of formed cylinders and transfer cylinders, said counter-pressure cylinder being shift able between a first position on a first side of said connecting line and a second position on a second side of said connecting line.

2. The rotary printing press of claim 1 further including a second five-cylinder printing unit, said first and second five-cylinder printing units being arranged horizontally adjoining each other.

3. The rotary printing press of claim 2 wherein at least one of said first and second five-cylinder printing units is horizontally displaceable.

4. The rotary printing press of claim 3 wherein said horizontal displacement of said at lest one of said first and second five-cylinder printing units is transverse to an axis of rotation of said counter-pressure cylinder.

5. The rotary printing press of claim 3 wherein said horizontal displacement of said at least one of said first and second five-cylinder printing units is in the direction of a longitudinal axis of rotation of said counter-pressure cylinder.

6. The rotary printing press of claim 1 further including at least a second five-cylinder printing unit, said first and second five-cylinder printing units being arranged one above the other.

7. The rotary printing unit of claim 1 wherein said cylinders in said five-cylinder printing unit can be shifted between a "V"-shaped arrangement and a "W"-shaped arrangement.

* * * * *